US009228341B2

(12) United States Patent
Troyer

(10) Patent No.: US 9,228,341 B2
(45) Date of Patent: Jan. 5, 2016

(54) SYSTEM AND METHOD FOR WATERPROOFING BELOW-GRADE WALL STRUCTURES

(71) Applicant: Hydrogard, LLC, Yorba Linda, CA (US)

(72) Inventor: Mark Anthony Troyer, Yorba Linda, CA (US)

(73) Assignee: HYDROGARD, LLC, Yorba Linda, CA (US)

( * ) Notice: Subject to any disclaimer, the term of this patent is extended or adjusted under 35 U.S.C. 154(b) by 0 days.

(21) Appl. No.: 14/714,129

(22) Filed: May 15, 2015

(65) Prior Publication Data

US 2015/0259902 A1 Sep. 17, 2015

Related U.S. Application Data

(63) Continuation of application No. 14/537,796, filed on Nov. 10, 2014, now Pat. No. 9,068,319.

(60) Provisional application No. 61/902,393, filed on Nov. 11, 2013.

(51) Int. Cl.

| | |
|---|---|
| ***E02D 19/00*** | (2006.01) |
| ***E04B 1/70*** | (2006.01) |
| ***E04B 1/66*** | (2006.01) |
| ***E04B 1/00*** | (2006.01) |
| ***E02D 31/02*** | (2006.01) |

(52) U.S. Cl.

CPC . *E04B 1/70* (2013.01); *E02D 31/02* (2013.01); *E04B 1/0007* (2013.01); *E04B 1/665* (2013.01)

(58) Field of Classification Search

CPC ..... E02D 17/00; E02D 19/00; E02D 31/00; E02D 31/02; E04B 1/665; E04B 1/66; E04B 1/68; E02B 3/16; E21D 5/016; E21D 11/38; E04G 23/0203

USPC ..... 52/169.5, 169.14

See application file for complete search history.

(56) References Cited

U.S. PATENT DOCUMENTS

| | | | | | |
|---|---|---|---|---|---|
| 3,656,268 | A * | 4/1972 | Murati | E02D 5/20 | 405/36 |
| 4,793,162 | A * | 12/1988 | Emmons | E02B 3/16 | 156/71 |
| 6,029,405 | A * | 2/2000 | Wood | E04H 3/14 | 52/169.14 |

* cited by examiner

*Primary Examiner* — Patrick Maestri

(74) *Attorney, Agent, or Firm* — Vista IP Law Group LLP

(57) ABSTRACT

System and methods for waterproofing a below-grade wall of a structure. The system comprises a waterproof membrane mounted directly or indirectly to an excavation wall within which the wall of the structure is to be constructed. A plurality of elongate waterstops are affixed to the waterproof membrane and arranged to form a plurality of compartments. A plurality of distribution tubes having apertures are affixed to the waterproof membrane to allow an injectable sealing grout to be injected through the distribution tubes and out of the apertures into a corresponding compartment. A plurality of supply tubes are installed in fluid communication with the plurality of distribution tubes with each of the supply tubes extending to a location on the interior of the wall to be constructed.

17 Claims, 4 Drawing Sheets

SYSTEM AND METHOD FOR WATERPROOFING BELOW-GRADE WALL STRUCTURES

CROSS-REFERENCE TO RELATED APPLICATIONS

This application is a continuation of U.S. patent application Ser. No. 14/537,796, filed Nov. 10, 2014, now issued as U.S. Pat. No. 9,068,319, which claims the benefit of U.S. provisional Application No. 61/902,393, filed on Nov. 11, 2013, in accordance with 35 U.S.C. Section 119(e), and any other applicable laws. The contents of the aforementioned application(s) are hereby incorporated herein by reference in their entirety as if set forth fully herein. Priority to each of the aforementioned applications is hereby expressly claimed in accordance with 35 U.S.C. §§119, 120, 365, 371 and/or any other applicable statutes.

BACKGROUND

The field of the invention generally relates to below-grade waterproofing of building foundations and basements, which are typically installed prior to the construction, pouring or installation of the wall structure being waterproofed.

It is known in structures having below-grade (i.e. sub-grade or underground) structures, such as large buildings with subterranean foundations, basements, mines and tunnels, to provide waterproofing to the underground structure to prevent groundwater from entering the structure. To this end, waterproofing systems have been developed, such as waterproof membranes lining the below-grade walls, and drainage systems to drain water away from the walls. The waterproof membranes may be affixed directly to the structure walls or to the excavation walls, or to other layers of material used in the waterproofing system such as permeable or non-permeable geotextiles, drain boards used to drain the water, and/or other structures.

SUMMARY

In one embodiment, the present invention is directed to an innovative system for waterproofing the walls of a structure, such as a building, tunnel or mine, having at least a part of the wall below-grade. In other words, an excavation is provided in the earth in which the walls (and commonly the foundation) of the structure will be constructed. The structure may be constructed of any suitable materials, but is commonly steel-reinforced concrete, in which concrete is poured over steel-reinforcement bar into forms constructed in the excavation to construct and install the walls.

The waterproofing system comprises a waterproof membrane which is mounted directly or indirectly to the excavation wall within which the walls of the structure are to be constructed. Thus, the waterproof membrane is located on the outside of the walls of the structure being waterproofed. The waterproof membrane may be mounted to the excavation wall itself, but may also be mounted indirectly by mounting the waterproof membrane to another structure which is mounted to the excavation wall or even to an intervening structure or layer mounted to the excavation wall, such as the shoring supporting the excavation wall, or another layer of material mounted to the shoring. The waterproof membrane has a first side which is facing the wall of the structure to be installed (i.e. the inside surface, wherein the inside indicates toward the inside of the wall of the structure), and a second side facing toward the excavation wall.

A plurality of elongate waterstops are affixed to the first side (i.e. the inside surface) of the waterproof membrane. The elongate waterstops are wall-like structures having a base attachable to the waterproof membrane and a wall structure extending outward from the base. The waterstops form an elongated wall along the waterproof membrane. The plurality of waterstops are arranged on the waterproof membrane to form a plurality of compartments on the waterproof membrane. For instance, the compartments may be a rectangular box shape formed by 4 sidewalls comprised of sections of the waterstops and a main wall formed by the waterproof membrane. When the wall of the structure is installed (e.g. by pouring a concrete wall against the waterproof membrane), the structure wall forms another wall opposing the main wall formed by the waterproof membrane thereby substantially enclosing the compartment.

The system further includes a plurality of distribution tubes affixed to the first side of the waterproof membrane. At least one distribution tube is located in each of the compartments. The distribution tubes have a least a first portion which is oriented laterally on the surface of the first side of the waterproof membrane such that a longitudinal axis of the distribution tube is substantially parallel to the first side of the waterproof membrane. The first portion of each distribution tube has a plurality of apertures to allow an injectable sealing grout to be injected through the distribution tube and out of the apertures into each compartment.

Each of the distribution tubes is connected to a supply tube in fluid communication with the corresponding distribution tube. The supply tube may be contiguous to the corresponding distribution tube (i.e. an integral part of the same tube) or it may be a separate tube connected to the distribution tube. The supply tubes have at least a first portion which extends away from the first side of the waterproof membrane and through the thickness of the wall to be installed. Hence, a proximal end of the supply tube is located at a location which will be at the interior of the wall of the structure when it is installed.

This innovative waterproofing system provides many benefits. For one, if there is a leak in the waterproofing system, it can be detected because water will flow into the apertures of the distribution tubes and through the supply tubes where the leak can be detected at the proximal end of the supply tube. Since the area of the structure wall is compartmentalized by the compartments formed by the waterstops, the leak can also be located to the compartment which has the leak. In addition, a source of pressurized sealing grout can be pumped through the supply tube for the leaking compartment, and through the corresponding distribution tube, to fill the compartment with sealing grout which spreads throughout the compartment and seals the leak.

In additional features and aspects of the present invention, the waterproofing system may also include other one or more of the following. One or more tube access boxes may be provided at the proximal end of the supply tubes to retain the input end of the supply tubes and to provide convenient access to the input end. Also, a protection layer of material may be affixed to the first side of the waterproof membrane which may both protect the waterproof membrane when the wall structure is installed, and also help distribute the sealing grout when it is injected into the compartments. Moreover, a drain board and/or base drain may be mounted directly or indirectly to the excavation wall.

In another feature, the waterproof membrane may be mounted using induction discs. The induction discs are first affixed to the excavation wall, directly or indirectly (such as affixing the discs to a layer disposed between the excavation wall and the waterproof membrane). The induction discs have a bonding surface coated with an adhesive. The bonding surface of each of the inductions discs is exposed adjacent the second side (outside surface) of the waterproof membrane. The waterproof membrane is positioned against the bonding surface and an inductive welding device is used to inductively weld the waterproof membrane to the inductive discs.

Another embodiment of the present invention is directed to a method for waterproofing a wall of a structure wherein the wall is at least partially below-grade. The waterproofing method comprises mounting a waterproof membrane directly or indirectly to an excavation wall within which the wall of the structure is to be constructed. A first side of the waterproof membrane is facing toward the wall to be installed and a second side is facing toward the excavation wall. A plurality of elongate waterstops (same as described above) are affixed to the first side of the waterproof membrane to form a plurality of compartments.

A plurality of distribution tubes are affixed to the first side of the waterproof membrane with at least one distribution tube located in each compartment. At least a first portion of the each distribution tube is oriented laterally on the surface of the waterproof membrane such that a longitudinal axis of the distribution tube is substantially parallel to the first side of the waterproof membrane. The first portion of each distribution tube has a plurality of apertures to allow an injectable sealing grout to be injected through the distribution tube and out of the apertures into each compartment. A plurality of supply tubes are installed such that each distribution tube is in fluid communication with a supply tube. The supply tubes may be contiguous to the corresponding distribution tube (i.e. an integral part of the same tube) or they may be separate tubes connected to the distribution tube.

In additional features and aspects of the present invention, this method embodiment of the waterproofing system may also include the installation and assembly of each of the additional features and aspects described above for the waterproofing system.

DETAILED DESCRIPTION

Figure 1:
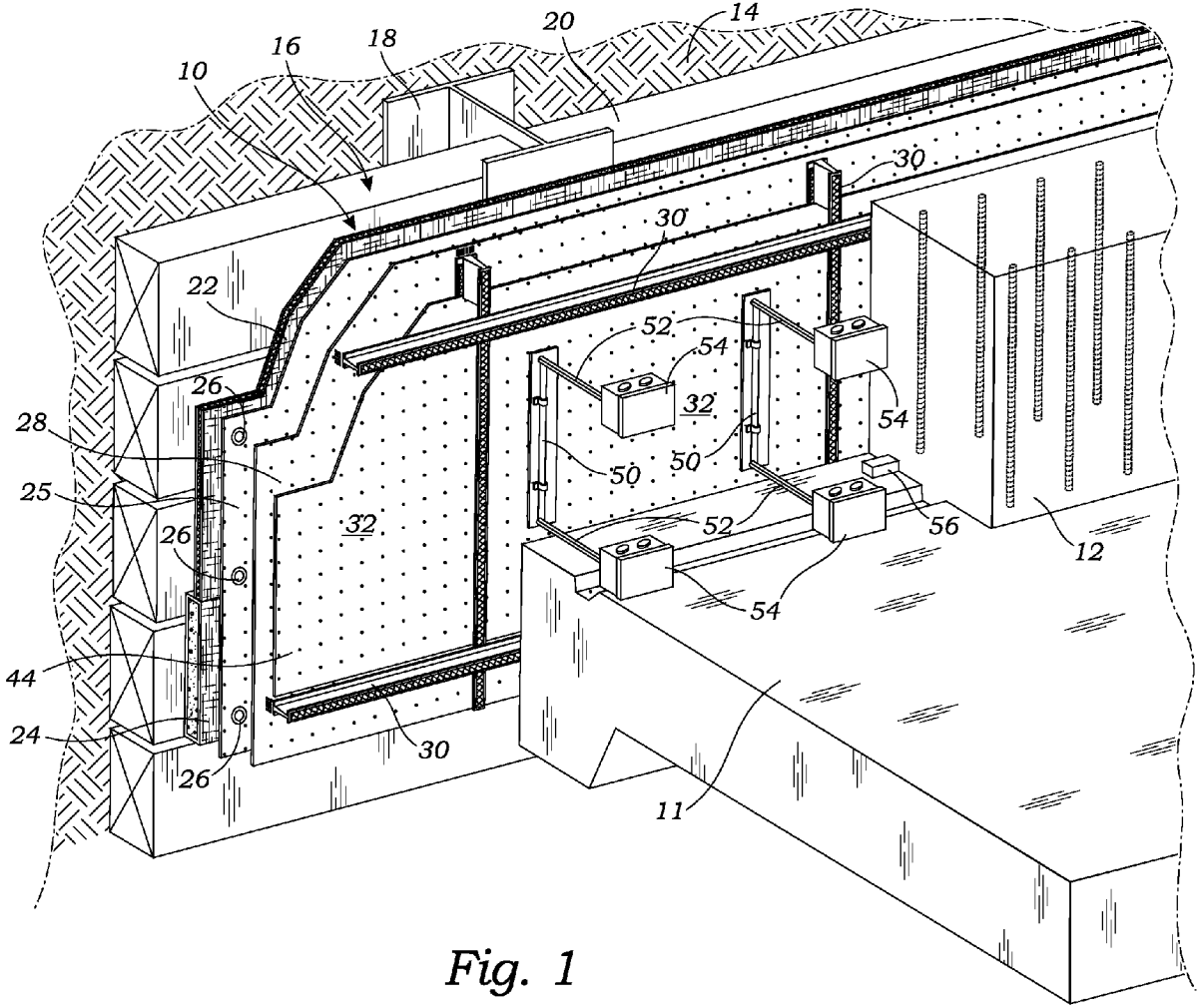
FIG. 1 is a cross-sectional perspective view of a waterproofing system, according to one embodiment of the present invention.

Referring to FIG. 1, one embodiment of a waterproofing system 10 according to the present invention is shown. As explained below, the present invention does not require all of the structure and features of the waterproofing system 10, but may include only some of the structures and features. The waterproofing system 10 is configured for waterproofing a wall 12 of a structure which when installed is at least partially below-grade, i.e. below the surface of the surrounding earth 14. When constructing large buildings, tunnels, mines and other structures having below-grade walls, an excavation is dug creating excavation walls 14 (earthen walls) within which the walls 12 and slab/foundation 11 of the structure will be constructed (also referred to as "installed" or "built"). Commonly, shoring 16 is constructed around the perimeter of the excavation to support the excavation walls 14. The shoring 16 may include steel piles 18 and wooden beams 20 supported by the piles 18.

The waterproofing system 10 is installed and/or constructed within the excavation walls 14 which may or may not include the shoring 16 as described above. The waterproofing system 10 is typically installed prior to constructing the slab 11 and walls 12, however, it may be possible to install the waterproofing system 10 after the slab 11 and walls 12 are constructed. The waterproofing system 10 will be described for installation prior to constructing the slab 11 and walls 12, with the understanding that it is also possible to install it after constructing the slab 11 and the walls 12. Also, the waterproofing system 10 will be described in relation to an excavation having shoring 16, with the understanding that the shoring 16 is optional, and the waterproofing system 10 may be installed in the excavation without shoring 16. Accordingly, any description describing the waterproofing system 10 or any of its components in relation to the shoring 16 also includes a description of the waterproofing system 10 or its components in relation to the excavation wall 14.

The waterproofing system 10 comprises a drain board 22 mounted to the shoring 16 by any suitable method, for instance fasteners such as screws, nails, bolts, etc. The drain board 22 has an outside surface facing toward the shoring 16 (and the excavation wall 14), and an inside surface facing toward the wall 12 to be constructed. The drain board 22 is configured to collect water which seeps into the excavation and to channel the water to a base drain 24. The drain board 22 may be any type of commercially available drain board used for such purposes. The drain board 22 extends from at or near the top of the shoring 16 down to a top edge of a base drain 24 mounted to the shoring 16 below the drain board 22. The base drain 24 may be mounted to the shoring similar to the drain board 22. The base drain 24 is configured to receive the water collected and channeled to the base drain 24 by the drain board 22 and to channel the water to a discharge pipe and/or a sump pump which drains the water out of the excavation and prevents water from building up around the below-grade walls 12 of the structure. The base drain 24 has an outside surface facing toward the shoring 16 and an inside surface facing toward the wall 12 and/or slab 11 to be constructed. The drain board 22 and base drain 24 are optional, and the waterproofing system 10 may be installed with or without these components. In an installation without the drain board 22 and base drain 24, the component(s) described below (e.g. the backing layer 25) which are described as being affixed to the drain board 22 and base drain 24 are affixed instead to the shoring 16 or directly to the excavation wall 14.

Figure 2:
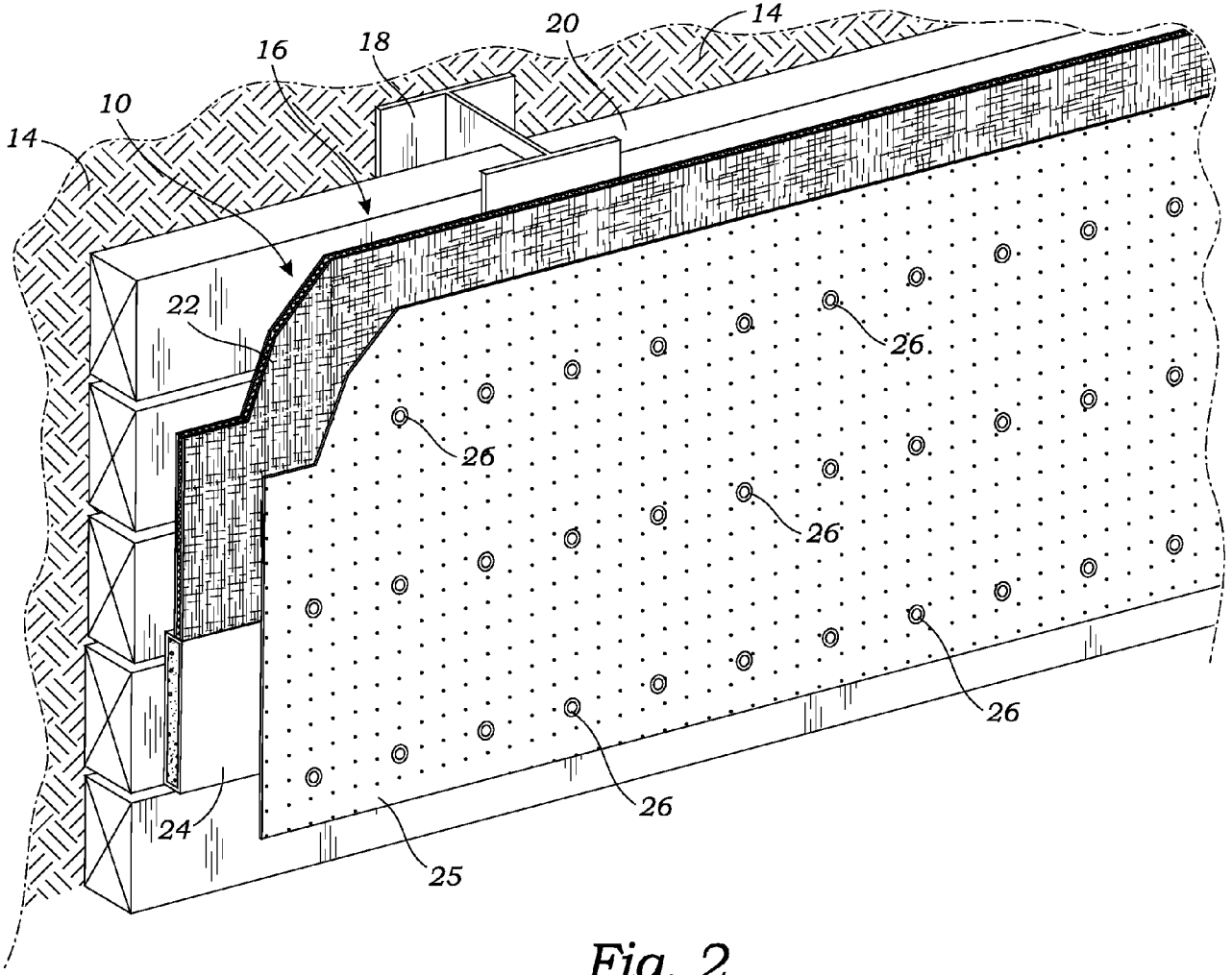
FIG. 2 is a cross-sectional perspective view showing the installation of a backing layer of a waterproofing system, according to one embodiment of the present invention.

Referring to FIG. 2, a backing layer 25 is affixed to, and substantially covers, the entire inside surface of the drain board 22 and the base drain 24. The backing layer 25 may be any suitable material, such as a geotextile, for example "HYDRO-ULTRAMAT SERIES™" geotextiles available from Hydro-Gard LLC, in Yorba Linda, Calif. As shown in FIG. 2, the backing layer 26 may be affixed to the drain board 22 and the base drain 24 using a plurality of spaced apart induction discs 26. The induction discs 26 may affix the backing layer 25 to the drain board 22 and base drain 24 using screws (or other suitable fasteners) which extend through a central hole in each induction discs 26 and then screw into the shoring 16, thereby securing the backing layer 25 to the shoring 16. The induction discs 26 have a circular disc having a bonding surface coated with an adhesive. The discs 26 may be approximately 3 inch diameter discs, or other suitable size, and the discs may be spaced about 14"-15" on center in a rectangular array on the backing layer 25, or other suitable spacing and configuration. For example, the induction discs may be the PVC Plate product from Valro Manufacturing Limited, in Knutsford, Cheshire, England, for use with the CENTRIX™ induction welding system. The discs 26 are mounted to the inside surface of the backing layer 25 such that the bonding surface is exposed.

A waterproof membrane 28 is mounted to the backing layer 25 (i.e. the waterproof membrane is indirectly mounted to the shoring 16 via the backing layer 25, drain board 22 and base drain 24) using the induction discs 26. As an example, the waterproof membrane 28 may be any suitable PVC membrane such as HYDRO-PRUFE™ 80 mil available from Hydro-Gard LLC, in Yorba Linda, Calif. A second side (the outside surface) of the waterproof membrane 28 is positioned adjacent the inside surface of the backing layer 25. Then, the waterproof membrane 28 is pushed into contact with each of the induction discs 26 and an inductive welder is used to inductively weld the waterproof membrane 28 to each of the induction discs 26, thereby mounting the waterproof membrane 28 to the backing layer 25. Multiple sheets of waterproof membrane 28 may be utilized to cover the entire surface of the backing layer 25. The seam between different sheets may be bonded together with a water-tight seal by heat welding the seam (e.g. using a hot air welder), as is known in the art.

Figure 3:
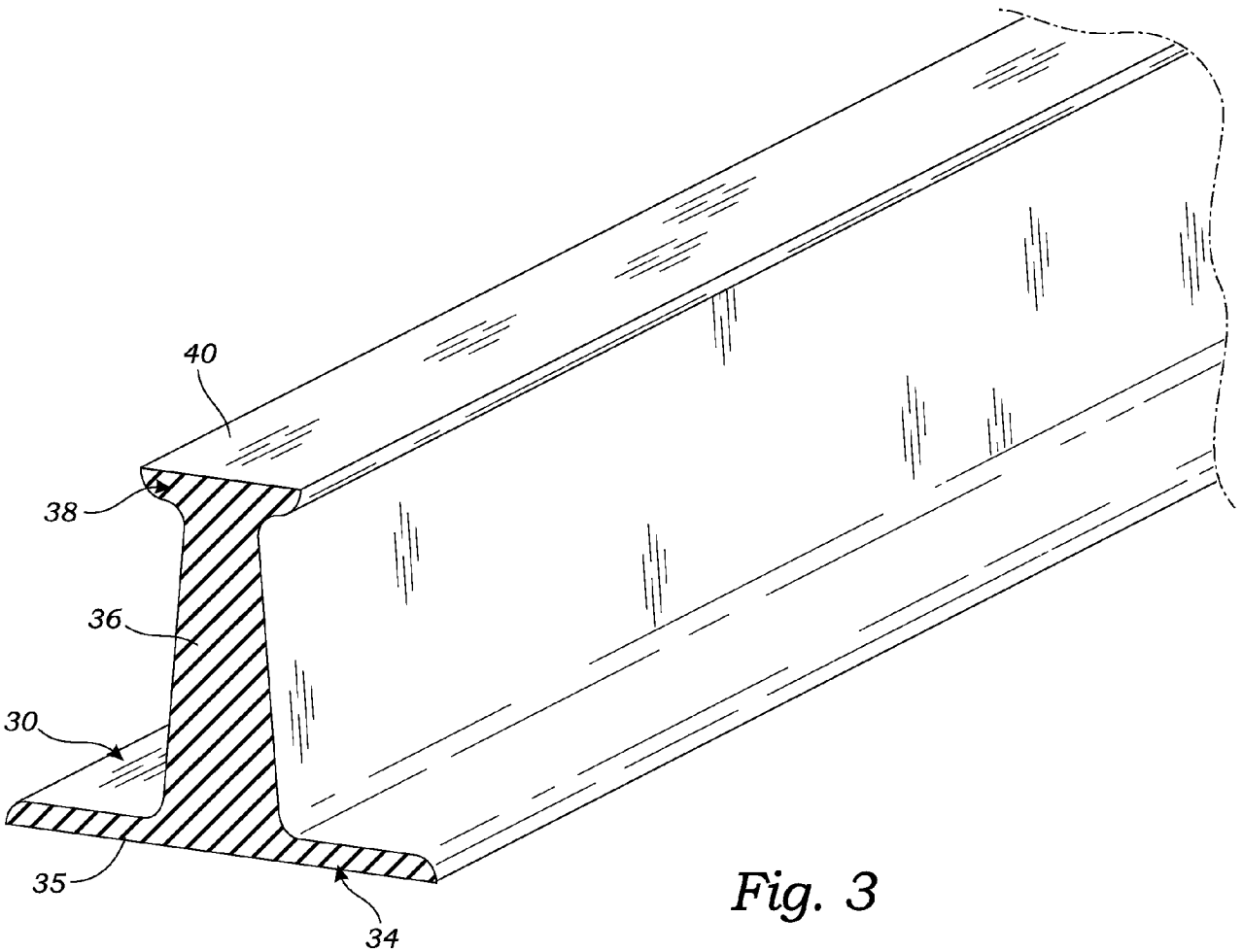
FIG. 3 is a perspective view of a portion of a waterstop of a waterproofing system, according to one embodiment of the present invention.
Figure 4:
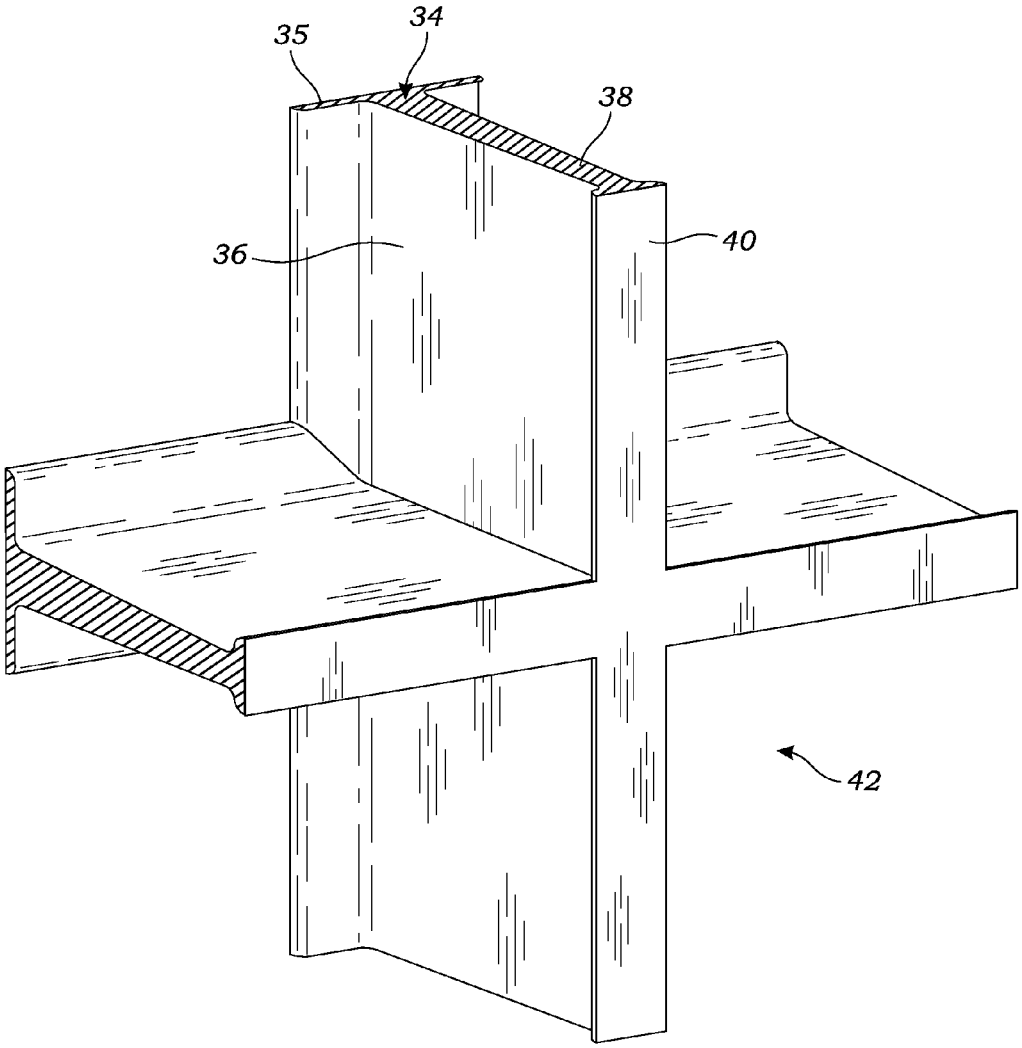
FIG. 4 is a perspective view of a cross tee waterstop of a waterproofing system, according to one embodiment of the present invention.

A plurality of elongate waterstops 30 are affixed to a first side (the inside surface) of the waterproof membrane 28. The elongate waterstops 30 are arranged on the waterproof membrane 28 to form a plurality of compartments 32 on the waterproof membrane 28. Referring to FIG. 3, the waterstops 30 have a base 34 having a flat bottom surface 35 which is attachable to the waterproof membrane 28, such as by heat welding (e.g. using a hot air welder) or by adhesive, or other suitable bonding means. The waterstops 30 have a web portion 36 which extends orthogonally from the base 34 to a top portion 38 having a substantially flat top surface 40. As can be seen in FIG. 3, the waterstops 30 have an I-beam shaped cross-section with the base 34 forming one of the flanges of the I-beam and the top portion 38 forming the other flange, and the web portion extending between and joining the two flanges. A water expandable material may be applied along substantially the entire length of the flat top surface 40 and/or also along the sides of the top portion of the web portion 36. The water expandable material may be a bentonite material or tape, such as "GARD-STOP SK™" tape available from Hydro-Gard LLC, in Yorba Linda, Calif. When it contacts water, the expandable material absorbs the water and expands. Thus, the expandable material can help seal the compartments 32 when there is a leak, such as a leak caused by a hole or tear in the waterproof membrane 28. The expandable material expands and seals against adjacent structure, such as the walls 12 and slab 11. Referring to FIG. 4, the intersections of the lengths of waterstop 30 may be formed using a cross tee portion 42 of waterstop 30. The different segments of waterstop 30 may be bonded together, such as bonding a straight length of waterstop to the cross tee portion 42, by heat welding or other suitable bonding means.

Referring back to FIG. 1, a plurality of distribution tubes 50 are also affixed to the first side of the waterproof membrane 28. At least one distribution tube 50 is located in each of the compartments 32, and as shown in FIG. 1, two distribution tubes 50 may be installed in each compartment 32. Each distribution tube 50 has a first portion oriented laterally along the surface of the first side of the waterproof membrane 28 such that a longitudinal axis of the distribution tube 50 is substantially parallel to the first side of the waterproof membrane 28. The first portion of each distribution tube 50 has a plurality of apertures (e.g. a perforated hose) to allow an injectable sealing grout to be injected through the distribution tube 50 and out of the apertures. The injectable grout then spread throughout the compartment 32.

Each of the distribution tubes 50 is connected to, and is in fluid communication with, a supply tube 52. The supply tubes 52 may be contiguous to the corresponding distribution tube 50 (i.e. an integral part of the same tube) or it may be a separate tube connected to the distribution tube 50. The supply tubes 52 do not have apertures, and are configured to convey an injectable sealing grout to the distribution tubes 50. The supply tubes 52 have at least a first portion which extends away from the first side of the waterproof membrane 28 and through the thickness of the wall 12 to be constructed such that a proximal end of the supply tube is located at a location which will be at the interior of the wall 12 of the structure when it is installed.

A tube access box 54 is connected to the proximal end of each of the supply tubes 52 to retain an input end of the supply tubes 52. The input end of each supply tube is configured to be connected to a supply of pressurized sealant grout. For instance, the input end may have a fitting or connector, such as a quick disconnect, which is connectable to a supply line of a sealant grout pump system. The tube access box 54 may be any suitable box having a tube aperture through which the supply tube 52 extends, and a removable cover to provide convenient access to the input end of the supply tube 52.

A protection layer 44 may also be affixed to the first side of the waterproof membrane 28 to help protect the waterproof membrane 28 from being damaged, such as punctures or tears, especially during the construction of the walls 12 and slab 11 adjacent to the waterproof membrane 28. The protection layer 44 is installed on substantially the entire first side of the waterproof membrane 28, except it does not cover the waterstops 30 or the distribution tubes 50. The protection layer 44 is preferably semi-permeable such that it allows the sealing grout to penetrate the protection layer 44 to reach the waterproof membrane 28, but does not allow the material forming the walls 12 and slab 11 (e.g. pourable concrete) to penetrate the protection layer 44. The protection layer 44 may any suitable material, such as a geotextile, for example, "HYDRO-ULTRAMAT™" available from Hydro-Gard LLC, in Yorba Linda, Calif.

Most commonly, after the waterproof system 10 is installed in the excavation walls 14, the slab 11 is constructed. For instance, the slab 11 may be a steel-reinforced concrete slab poured into place. Once the slab 11 is constructed, a waterstop 56 may be placed around the slab to seal the joint between the slab 11 and the walls 12. Then, the walls 12 are constructed, such as by pouring the concrete walls 12 over steel reinforcement bars ("rebar"). As the concrete is poured into place, it forms around the waterstops 30 and up to the protection layer 44, leaving a small air gap between the protection layer 44 and the distribution tubes 50 on one side and the concrete wall 12 on the other side.

In the case of a leak, such as a hole in the waterproof membrane 28, the water will enter the compartment and fill the gap or air space in the compartment, then work its way into the distribution tube 50 and flow through the supply tube 50 and then will be show up in the access box 54. The leak can then be detected by examining the access box 54. Alternatively, an electronic moisture sensor can be installed in each of the access boxes 54, and can be connected to a monitoring station, such as a computer or other electronic device which can provide a warning message when a moisture sensor detects water. The warning message may also identify the particular sensor or access box 54 at which the leak is detected. Since the area of the wall 12 is compartmentalized by the compartments 32 formed by the waterstops 30, this also locates the leak to the particular compartment 32 which has the leak. Then, a source of pressurized sealing grout can be connected to the input end of each of the supply tubes 52 for the leaking compartment 32 (there may be only one supply tube 52 for a compartment), and sealing grout can be pumped through the supply tubes 52 and through the corresponding distribution tubes 50, to fill the compartment 32 with sealing grout. The sealing grout then distributes throughout the compartment, which may be facilitated by the protection layer 44, to the location of the leak. The grouting material then cures and seals the leak.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

What is claimed is:

1. A system for waterproofing a wall of a structure wherein the wall is at least partially below-grade, comprising:

a waterproof membrane having a first side and a second side, the waterproof membrane mounted directly or indirectly to an excavation wall within which the wall of the structure is to be constructed with the first side facing away from the excavation wall, and the second side facing toward the excavation wall;

a plurality of elongate waterstops affixed to the first side of the waterproof membrane, the waterstops arranged on the waterproof membrane to form a plurality of compartments;

a plurality of distribution tubes each having a respective first portion affixed to the waterproof membrane within a respective compartment, the first portion of each distribution tube having at least one aperture to allow an injectable sealing grout to be injected through the distribution tube and out of the aperture into the corresponding compartment; and a plurality of supply tubes in fluid communication with the plurality of distribution tubes, each of the supply tubes having at least a first portion extending away from the first side of the waterproof membrane and along a path from a location which is exterior to the wall to be constructed to a location at the interior of the wall to be constructed.

2. The system of claim 1, further comprising:

a plurality of tube access boxes, each tube access box coupled to an input end of a corresponding one of the supply tubes for providing access to the input end of the corresponding supply tube to inject a pressurized flow of injectable sealing grout into the corresponding supply tube.

3. The system of claim 1, further comprising:

a protection layer affixed to the first side of the waterproof membrane and covering substantially all of the waterproof membrane except for the waterstops.

4. The system of claim 3, wherein the protection layer is formed from a geotextile matt.

5. The system of claim 1, wherein the waterstops have a layer of water expandable material applied along substantially the entire length of the top portion of the waterstops.

6. The system of claim 5, wherein the water expandable material is formed of bentonite.

7. The system of claim 1, further comprising:

a drain board mounted to the excavation wall or shoring supporting the excavation wall with an outside surface of the drain board facing toward the excavation wall or shoring supporting the excavation wall and an inside surface facing toward the location of the wall to be constructed;

a base drain mounted to the excavation wall or shoring supporting the excavation wall, the base drain affixed below the drain board such that fluid draining down the drain board is collected by the base drain, the base drain having an outside surface facing toward the excavation wall or shoring supporting the excavation wall and an inside surface facing toward the wall to be constructed;

a backing layer affixed to the inside surface of the drain board and base drain; and a plurality of induction discs having a conductive element and a bonding surface coated with an adhesive, the induction discs affixed to an inside surface of the backing layer such that the bonding surface and adhesive are adjacent the second side of the waterproof membrane;

wherein the waterproof membrane is affixed to the excavation wall or the shoring supporting the excavation wall by the waterproof membrane having been inductively-welded to the induction discs.

8. The system of claim 1, wherein the waterstops each have a base for attachment to the first side of the waterproof membrane and a web portion extending to a top portion.

9. A method for waterproofing a wall of a structure wherein the wall is at least partially below-grade, comprising:

mounting a waterproof membrane having a first side and a second side directly or indirectly to an excavation wall within which the wall of the structure is to be constructed with the first side facing away from the excavation wall, and the second side facing in the direction of the excavation wall;

affixing a plurality of elongate waterstops to the first side of the waterproof membrane, the waterstops arranged on the waterproof membrane to form a plurality of compartments;

affixing a plurality of distribution tubes to the waterproof membrane, each distribution tube affixed having a respective first portion affixed to the waterproof membrane within a respective compartment, the first portion of the distribution tube having a plurality of apertures to allow an injectable sealing grout to be injected through the corresponding distribution tube and out of the corresponding apertures into each compartment; and installing a plurality of supply tubes wherein each distribution tube is in fluid communication with a corresponding supply tube.

10. The method of claim 9, further comprising:

installing a plurality of tube access boxes, each tube access box coupled to an input end of one of the supply tubes for providing access to the input end of the supply tube to inject a pressurized flow of injectable sealing grout into the supply tube.

11. The method of claim 9, further comprising:

affixing a protection layer to the first side of the waterproof membrane, the protection layer covering substantially all of the waterproof membrane except for the waterstops.

12. The method of claim 11, wherein the protection layer is formed from a geotextile matt.

13. The method of claim 9, wherein the waterstops have a layer of water expandable material applied along substantially the entire length of the top portion of the waterstops.

14. The method of claim 13, wherein the water expandable material comprises bentonite.

15. The method of claim 9, further comprising:

mounting a drain board to the excavation wall or shoring supporting the excavation wall with an outside surface of the drain board facing toward the excavation wall or shoring supporting the excavation wall and an inside surface facing toward the wall to be constructed;

mounting a base drain to the excavation wall or shoring supporting the excavation wall, the base drain affixed below the drain board such that fluid draining down the drain board is collected by the base drain, the base drain having an outside surface facing toward the excavation wall or shoring supporting the excavation wall and an inside surface facing toward the wall to be constructed;

affixing a backing layer to the inside surface of the drain board and base drain;

installing a plurality of induction discs having a conductive element and a bonding surface coated with an adhesive on an inside surface of the backing layer such that the bonding surface and adhesive are adjacent the second side of the waterproof membrane; and wherein the waterproof membrane is mounted indirectly to the excavation wall by inductively welding the waterproof membrane to the induction discs.

16. The method of claim 9, wherein the waterstops each have a base for attachment to the first side of the waterproof membrane and a web portion extending to a top portion.

17. The method of claim 9, wherein each of the supply tubes extends from a location which is exterior to the wall to be constructed to a location which is at the interior of the wall to be constructed.

* * * * *